US005366481A

United States Patent [19]

Zade

[11] Patent Number: 5,366,481

[45] Date of Patent: Nov. 22, 1994

[54] SANITARY RETRACTABLE BABY PACIFIER

[76] Inventor: Ismail Y. Zade, 25 Larissa La., Thornwood, N.Y. 10594

[21] Appl. No.: 181,822

[22] Filed: Jan. 18, 1994

[51] Int. Cl.[5] ..... A61J 17/00

[52] U.S. Cl. ..... 606/236; 606/234

[58] Field of Search ..... 606/234–236; 215/11.1–11.6; D24/194–199

[56] References Cited

U.S. PATENT DOCUMENTS

| | | | |
|---|---|---|---|
| 3,129,709 | 4/1964 | Rountree | 606/234 |
| 3,363,630 | 1/1968 | Hines | 606/234 |
| 4,329,996 | 5/1982 | Copeland | 606/234 |
| 4,867,159 | 9/1989 | Fulton | 606/236 |
| 4,878,496 | 11/1989 | Chen | 606/234 |
| 5,156,617 | 10/1992 | Reid | 606/234 |
| 5,211,656 | 5/1993 | Maddocks et al. | 606/234 |

*Primary Examiner*—Stephen C. Pellegrino
*Assistant Examiner*—Glenn K. Dawson
*Attorney, Agent, or Firm*—Martin J. Spellman, Jr.

[57] ABSTRACT

A retractable pacifier having a cylindrical housing with a shield member at one end and a wall with an aperture at the other end. Near the top and bottom of the inner wall of the housing are retainer slots for cooperating with spaced tabs or nibs on the periphery of a disk attached to the base of a nipple for locking the nipple in an extended position or a retracted position.

1 Claim, 3 Drawing Sheets

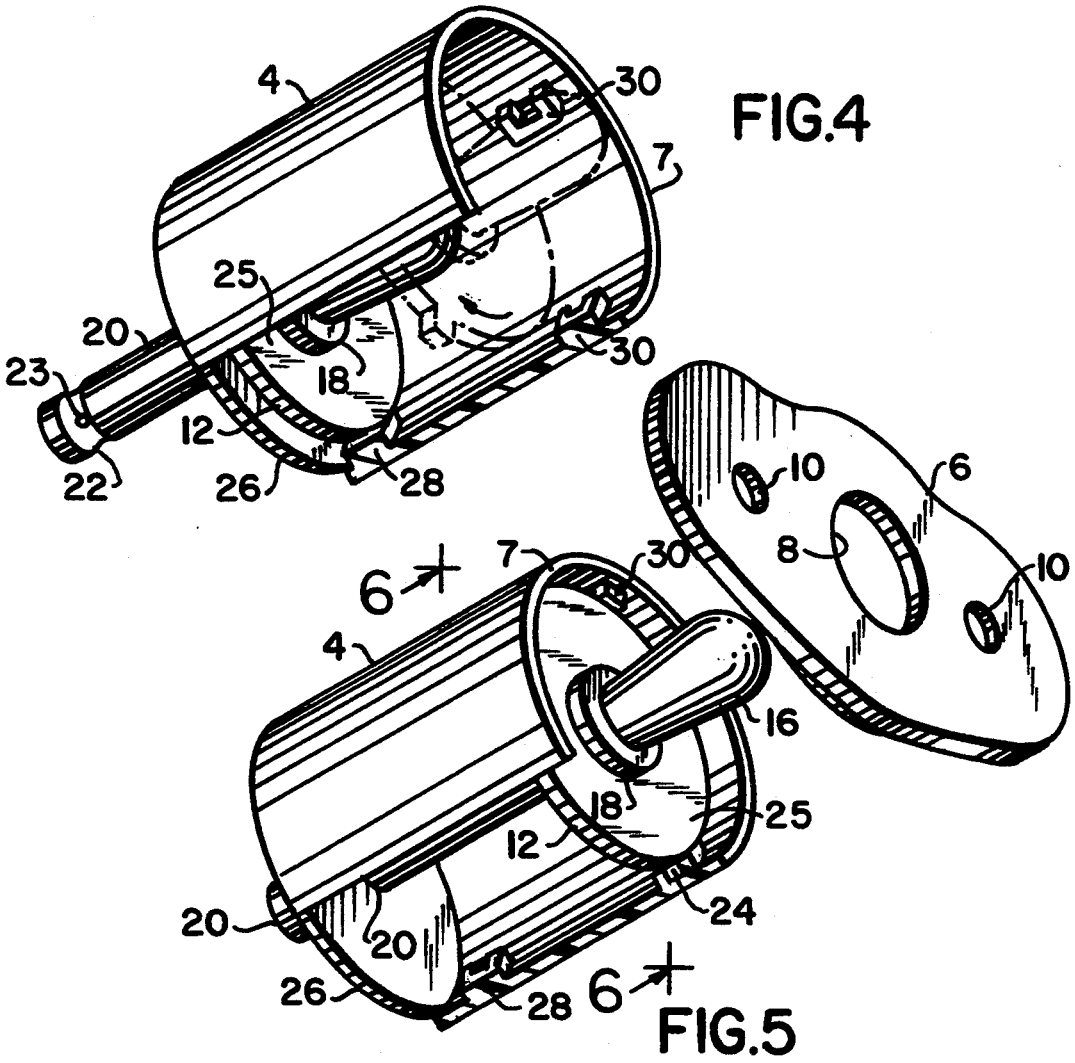
FIG.4
FIG.5
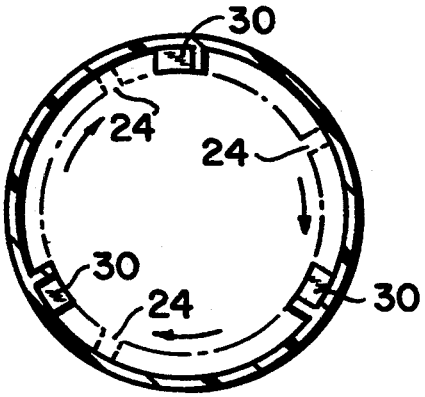
FIG.6
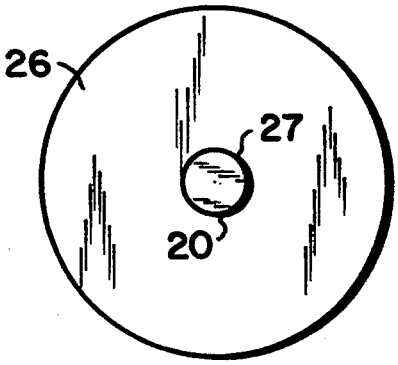
FIG.7

SANITARY RETRACTABLE BABY PACIFIER

BACKGROUND OF THE INVENTION

1. FIELD OF THE INVENTION

This invention relates to a sanitary baby pacifier wherein the nipple may be stored in a unique storage cylinder where it is protected and free from dust and germs. The infant is entertained when the nipple of the pacifier is extended from storage for use by the infant.

Through the years, a number of pacifier devices have been developed for use in providing a soothing device for use by a human infant.

2. PRIOR ART

U.S. Pat. No. 3,363,630, Hines, C. F.—In FIG. 2, item (28) shows a central opening through which nipple (10) passes through that has no side cover to cover the narrow or end part of the nipple when the nipple is extended from the shield, in this case air easily can pass through to the baby's mouth. Hines also claims that "nipple (10) retracts from the infant's mouth when suction subsides, as the infant falls asleep." We known that if the large part of the nipple comes out from the plate (top part of the mouth), and the baby's mouth will stay open and air again will pass into the baby's mouth, therefore swallowing air may cause colic pain.

U.S. Pat. No. Des. 243,366, Lybe, L. L. et. al., February 1977—Discloses a separable casing pacifier which may protect the pacifier from dirt, but it is very difficult to remember where in each instance you had the pacifier case. Therefore, it is not very practical. Also some pacifiers are in different shape, hence its not useful in all pacifiers.

U.S. Pat. No. 4,819,641, Russell, et. al., April, 1989—Discloses a pacifier mounted on a concave base member which is covered by a concave top member with an elongated slot and collapsible side wall secured to the base member. A pair of handle members running through the base member and attached to the top or cover member may be pulled to firm down the top member to collapse it on the base member to cause the nipple to extend through the slot in the top member to be exposed. The use is very awkward. In this sanitary baby pacifier, as shown in FIG. 4 nipple member 50 extends through slot (12). Nipple member 50 has a rounded nipple end 51 and cylindrical nipple stem 52, which joined to the interior of base 20. During exposure of the nipple member 50 for the utilizing by the infant, since nipple stem 52 is thinner than nipple member 50 and air can pass to the baby's mouth during sucking through slot 12. The inventor claimed that top 11, shown at FIG. 3 may be completely removed from base 20 by passing slots 24, 25 and 26 (if it is fixed onto handles 55, 56—then it can't be removable and if it is fixed to the collapsible accordion structure 13–15, top 11 will move when sucking action is applied and the baby can't fix top 11 on their lip. In this way, air can pass to the baby's mouth and also this pacifier doesn't show holes on top 11, which is one of the important requirements for a baby pacifier.

U.S. Pat. No. 2,860,639, Hoover—Discloses a pacifier wherein the conical member can slit easily, the shield is removable, positioned in registry over the peripheral edge of the disc and mounted over the nipple resulting in total separation of the conical cover from the pacifier. It is not convenient to remember each time where you left the cover of the nipple.

U.S. Pat. No. 3,129,709, Roundtree, J.D., April 1964—This was designed for when it is time to train children to stop sucking the pacifier by gradually adjusting the degree of extension of the nipple from the container. If the nipple is shorter than normal in the baby's mouth, however, the result will be that the baby can't suck properly and air will enter into the baby's mouth. Because sucking mechanisms on the pacifier the "baby will keep the head of the nipple between long curve of soft palate and in back of the tongue, then it closes around the nipple neck with their lips, mucosa, manibula, and the frontal part of the tongue and air can't pass the baby's mouth during sucking. However, if the nipple is short, the baby can't prevent air entering its mouth and may well get colic pain and vomiting. This design is useful when the mother wants to stop the baby's sucking habit on the pacifier and it requires a screwdriver each time when making adjustments for the nipple, which isn't very convenient.

European patent application, Chen, Bo-Zhou, April, 1987—This is a self retractable rubber nipple, which is intended to prevent an infant from getting into a habit of using a nipple continuously by slowly retreating it from the mouth by bellowing air volume control unit 20 and expanding hollow 10, to such an extent that the nipple can disengage from the mouth of an infant slowly without its notice. The operation isn't hygienic. Since the mother or baby caretaker must put their mouth to the air control 20 bellows even when the baby is sleeping. There isn't any control of how much she must bellow. No doubt, the mother or caretaker may give their infant an infection, by putting their mouth near baby's nose and mouth several times a day. Also the air control 20 is fixed only at one side so it will be flexible, therefore the baby can't control nipple 3 by fixing their lip on plate 2, so air can pass into the baby's mouth.

A baby who has a sucking pacifier gets less irritable and cries less in case of hunger or wetness. If a baby is angry, his heart rate increases and his breathing rate increases. The baby sucks his pacifier vigorously during his anger. Sucking the pacifier reduces his anxiety, heart beat, and his breathing rate. The baby cries less while sucking a pacifier during medical procedures like blood drawing, or vaccinations.

Premature infants who use a pacifier to exercise the sucking muscle development, whether such baby uses a bottle or breast feeding, develop quicker than those who are not given a pacifier. Consequently, a baby using a pacifier stays in the hospital less time and lowers hospital costs.

Premature infants are live born infants delivered before 37 weeks gestation or with birth weight of 2,500 grams or less. The incidents of low birth weight in our society is 7% for white live born infants and 13.4% for non-white infants. Infants as small as 1,350 grams at birth occasionally are vigorous enough for bottle feedings.

The pacifier serves to help prevent thumb sucking and other undesirable sucking habits. A pacifier provides exercise for the baby's jaw, cheek and tongue muscles, increases secretion of digestion enzymes, and helps digestion.

infants don't suck a pacifier all of the time. During periods of non-use, the nipple can become contaminated with germs by touching clothes, hands, bed materials or falling on the ground. Most mothers don't wash this pacifier each time or they don't have the facility everywhere to wash or brush with soap when the nipple is dropped. The nipple might get infected and the baby may get thrush or diarrhea and vomiting.

SUMMARY OF THE INVENTION

This invention concerns a shield device and protective cylinder structure in combination with a sucking pacifier nipple. The middle of the shield has an aperture for switching the nipple easily into and out of the cylindrical structure and locking in an extended or retracted position.

The nipple is carried on a circular disk base having equispaced nibs which extending for the periphery of the disk to selectively engage and disengage longitudinal slots on an inner wall of a cylindrical external shield. This dish may be rotated by a base handle extending from the disk so as to cause the nibs to move in and out of engagement with the slots at the upper and lower end of said cylinder. Thus it is readily moved from a stored, protected position to an exposed sucking position as desired.

The shield is fixed to the outer end of the cylindrical structure and has two holes at each side of the shield. It permits air entry for infants breathing in from the mouth, and also the passing of feeding supply tubes to sick babies or premature babies who cannot suck or wherein the sucking reflex is not strong enough for adequate feeding.

This new pacifier stores the nipple in a manner which avoids subjecting it to dirt or bacterial contaminants. This sanitary pacifier is light, soft, durable and free from dirt and germs. It is odorless and tasteless. The nipple is fixed permanently and locked, which can't come out front the shield to go to the baby's throat to cause asphyxia.

The present invention provides an improved specific structure for the baby pacifier. Most of the artists who developed pacifiers did not know or did not take into consideration the mechanism of a baby's mouth, muscle and tongue during sucking.

In sucking, infants either feel the nipple by squeezing the alveolar sinuses between the front of the tongue and hard palate, therefore the nipple must be short, soft and in the shape of the nipple of the human breast. This pacifier will have all of the characteristic structures mentioned, which prevents air passing into the baby's mouth.

The nipple and shield are soft, flexible and able to adjust to the lips. The top of the shield, or "nipple shelter" is a smooth cylinder end and disk. The nipple of the pacifier can be safely and sanitarily stored and transported.

BRIEF DESCRIPTION OF THE DRAWING

In the accompanying drawing which forms a part of this specification:

FIG. 4 is a perspective view of the device with a portion of the storage cylinder cut away to reveal the internal arrangement of the component parts with the nipple and its mounting showing in phantom, in a transition position;

FIG. 5 is a perspective view similar to FIG. 4 with the nipple in the raised position.

FIG. 6 is a sectional view along line 6—6 of FIG. 5;

FIG. 7 is a bottom view of the device;

ILLUSTRATIVE SPECIFIC EMBODIMENT

Figure 1:
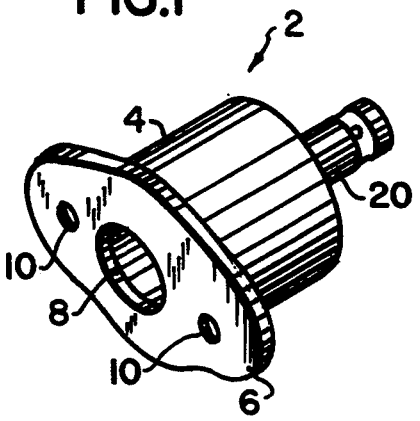
FIG. 1 is a perspective view of the pacifier device of the present invention, part showing the main component.
Figure 2:
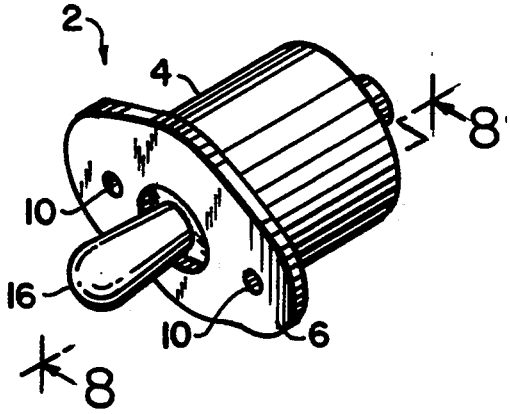
FIG. 2 is a perspective view of the assembled device with the nipple extending from the shield and storage cylinder.
Figure 3:
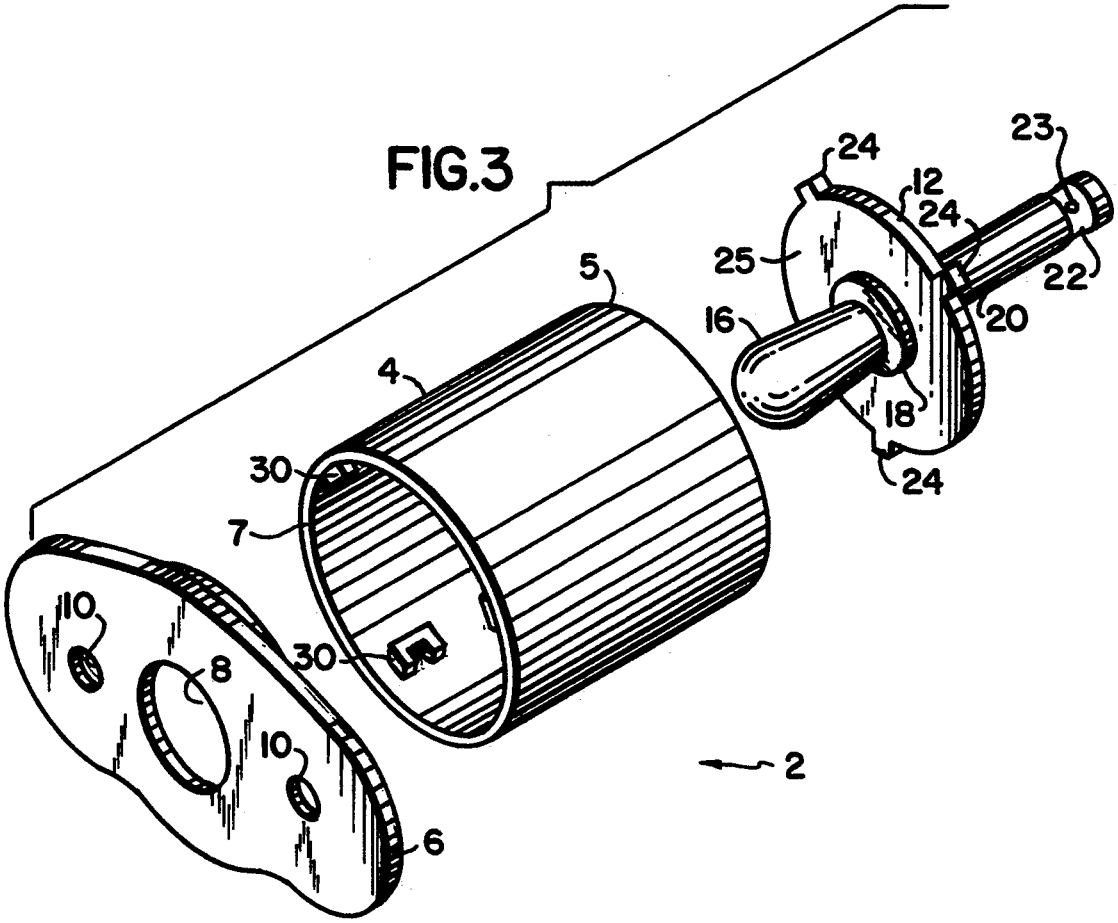
FIG. 3 is a perspective view of the assembled device with the nipple retracted within the protective shield and storage container.
Figure 8:
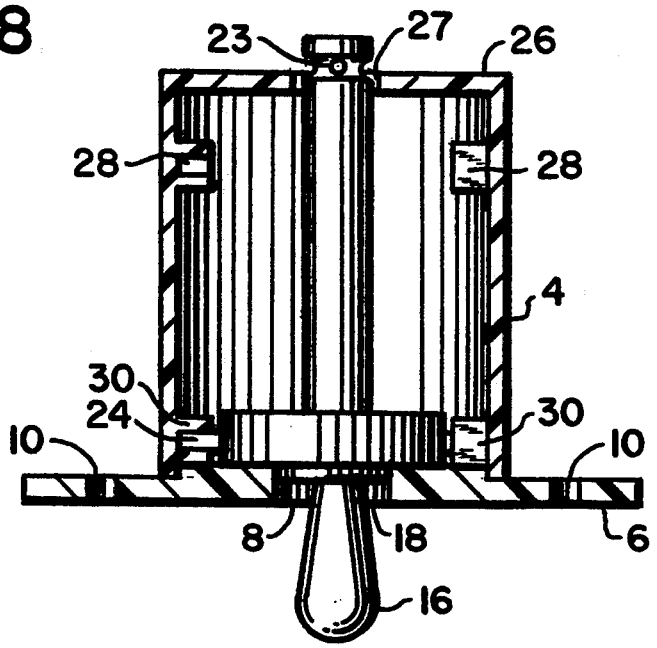
FIG. 8 is a sectional view of device along line 8—8 of FIG. 2 with the nipple in the extended position.
Figure 9:
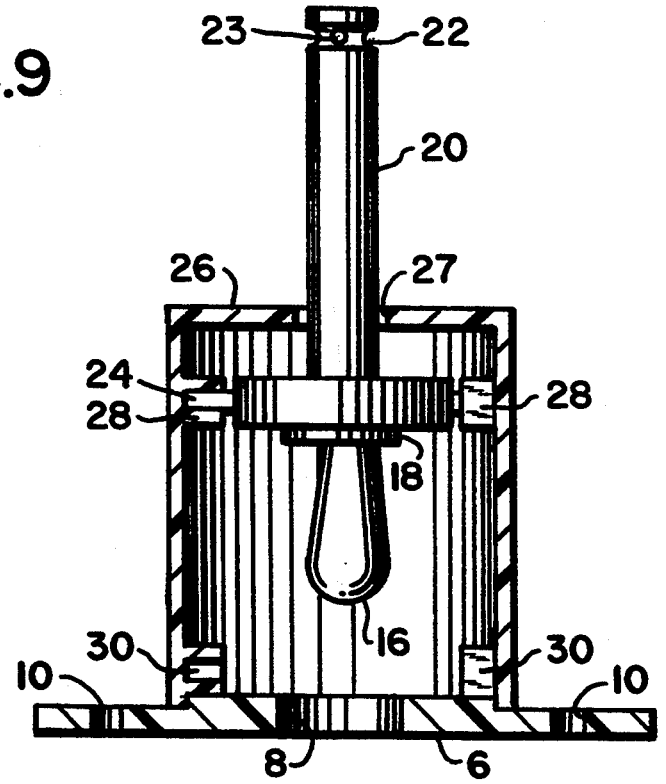
FIG. 9 is a sectional view of the device similar to FIG. 8 with the nipple in the retracted position.

Referring to the accompanying drawing, the baby pacifier of the present invention is indicated in general at 2 and comprises a cylindrical container 4 having a base end 5 and a top end 7. The top end 7 is closed by the nipple shield 6 having an aperture 8 in the center thereof for the nipple and smaller apertures 10 on either side thereof to allow air to always be available to the infant's mouth. The nipple 16 is carried on a base disk 12 and includes the base 18 of the nipple 16 which is secured to the disk 12. The lower side of the disk 12 has a handle or stem section 20 secured thereto with an annular depression 22 therein and perpendicular aperture 23 for securing a holding ring or like holding device as an option. The lower end 5 of the cylinder member is closed by the circular member 26 which has central aperture 28 therein through which the stem 20 can pass. Equally dispersed on the perimeter of the base 26 of the cylinder floor are retainer slots of C-shaped cross section 28 which engage tabs or nibs 24 extending from the periphery of the disk 12 to hold the nipple 16 in the retracted position. Just below the top end 7 of the cylinder body 4 are similar clamping devices 30 to hold the nipple 16 in the extended position by engaging the tabs 24. This is readily accomplished by a simple clockwise turning motion to engage, and a counterclockwise motion to disengage, and allow the disk to move downwardly within the protective cylindrical body 4. The disk 25 carrying the nipple 16 is thus moved upwardly or downwardly within the cylindrical container 4 easily. It is clear that the device of the present invention provides a means for conveniently storing the nipple in the recessed position to prevent contamination and the accumulation of dirt and germs and one in which the nipple was desired for use is easily extended.

While the invention has been described by reference to an illustrative embodiment, it is not intended that the novel device be limited thereby, but that modifications thereof are intended to be included as falling within the broad spirit and scope of the foregoing disclosure, the following claims and the appended drawings.

What is claimed is:

1. A pacifier device comprising a nipple having a base, retractable and extendable within a cylindrical storage container having an interior cylindrical wall and a bottom end with a bottom wall with a central aperture therein, a top end of said cylindrical storage container having a protective shield extending laterally outwardly from said top end of said cylindrical storage container, said shield having at least two apertures therein to provide air passage to the infant user's mouth, said nipple being mounted at its said base on an upper side of a circular disk having a periphery, said disk being transversely mounted in said cylindrical storage container, a handle extending from a lower side of said disk and through said central aperture in said bottom wall of said cylindrical storage body, said handle move-able longitudinally with respect to said cylindrical storage container, spaced nibs extending from said periphery of said disk and engageable in corresponding retainer slots on said interior cylindrical wall adjacent said top and bottom ends for locking said nipple in an extended position as said disk is in a raised position with one of said spaced nibs in one of the retainer slots adjacent the top end, and in a retracted position as said disk is in a lowered position with one of said spaced nibs in one of the retainer slots adjacent the bottom end, said shield having a central aperture through which said nipple may pass.

* * * * *